US008693718B2

(12) United States Patent
Agustiar et al.

(10) Patent No.: US 8,693,718 B2
(45) Date of Patent: Apr. 8, 2014

(54) RECEIVER TUBE, RECEIVER AND HEARING AID INSTRUMENT WITH A RECEIVER TUBE

(75) Inventors: Agustiar, Singapore (SG); Mo Choong Marie Chan, Singapore (SG); Wee Haw Koo, Singapore (SG); Ju Lin Teo, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 883 days.

(21) Appl. No.: 12/835,912

(22) Filed: Jul. 14, 2010

(65) Prior Publication Data

US 2011/0013796 A1 Jan. 20, 2011

(30) Foreign Application Priority Data

Jul. 14, 2009 (DE) ..... 10 2009 032 981

(51) Int. Cl.
*H04R 25/00* (2006.01)

(52) U.S. Cl.
USPC ..... 381/322

(58) Field of Classification Search
USPC ..... 381/322, 324, 325, 327, 328, 330
See application file for complete search history.

(56) References Cited

U.S. PATENT DOCUMENTS

| | | | | |
|---|---|---|---|---|
| 4,418,787 | A | 12/1983 | Eggert et al. | |
| 6,009,183 | A * | 12/1999 | Taenzer et al. | 381/330 |
| 6,522,764 | B1 | 2/2003 | Bøgeskov-Jensen | |
| 7,110,562 | B1 * | 9/2006 | Feeley et al. | 381/322 |
| 7,684,579 | B2 * | 3/2010 | Ochsenbein et al. | 381/324 |
| 7,715,582 | B2 * | 5/2010 | Ochsenbein | 381/330 |
| 8,121,328 | B2 * | 2/2012 | Kral et al. | 381/330 |
| 8,130,993 | B2 * | 3/2012 | Ho et al. | 381/330 |
| 2005/0232453 | A1 | 10/2005 | Fideler | |
| 2007/0183612 | A1 * | 8/2007 | Ochsenbein et al. | 381/322 |
| 2008/0002848 | A1 | 1/2008 | Heerlein et al. | |

(Continued)

FOREIGN PATENT DOCUMENTS

| | | | |
|---|---|---|---|
| CH | 664 057 | A5 | 1/1988 |
| DE | 94 08 054 | U1 | 7/1994 |
| DE | 10 2006 029 819 | A1 | 1/2008 |
| WO | 20091016671 | A1 | 2/2009 |

OTHER PUBLICATIONS

Ulrich, et al., "Hörakustik Theorie and Praxis", 2007, pp. 243-245 and pp. 694-703, DOZ-Verlag, ISBN 978-3-922269-80-9.

*Primary Examiner* — Jeffrey Donels
(74) *Attorney, Agent, or Firm* — Laurence A. Greenberg; Werner H. Stemer; Ralph E. Locher

(57) ABSTRACT

A receiver tube for connecting a receiver to a hearing aid instrument and a hearing aid instrument with a receiver tube, include a connection which ensures good acoustic stability and low feedback tendencies, can be produced in an uncomplicated manner and has high impact and shock strength. The receiver tube includes a receiver connector constructed as a cup at least partly holding a receiver when connected together. The receiver connector includes a form-locking mechanism for a receiver and a flexible element for locking the receiver. The form-locking connection simplifies installation of the receiver during production or replacement by requiring neither application of a force, as when pretensioning or expanding force-locking connections, nor establishment of an adhesive connection. The locking mechanism can be opened/closed by the flexible element. The cup-shape of the receiver connector contributes to increased rigidity and reliability of the form-locking connection to the receiver and an acoustic shield.

13 Claims, 3 Drawing Sheets

(56) References Cited * cited by examiner

U.S. PATENT DOCUMENTS

| | | | | |
|---|---|---|---|---|
| 2008/0298619 | A1* | 12/2008 | Kral et al. | 381/330 |
| 2010/0246870 | A1* | 9/2010 | Gommel et al. | 381/322 |
| 2011/0299708 | A1* | 12/2011 | Bondo et al. | 381/312 |

RECEIVER TUBE, RECEIVER AND HEARING AID INSTRUMENT WITH A RECEIVER TUBE

CROSS-REFERENCE TO RELATED APPLICATION

This application claims the priority, under 35 U.S.C. §119, of German Patent Application DE 10 2009 032 981.1, filed Jul. 14, 2009; the prior application is herewith incorporated by reference in its entirety.

BACKGROUND OF THE INVENTION

Field of the Invention

The invention relates to a receiver tube for connecting a receiver of a hearing aid instrument. The invention also relates to a receiver and a hearing aid instrument with such a receiver tube.

Hearing aid instruments generally have a housing in which a microphone, an amplifier and a receiver are disposed. Additionally, there is a need for an energy supply, which is usually in the form of a battery that can be rechargeable. The receiver is connected to an acoustic output of the housing in order to be able to transmit acoustic output signals of the receiver outward to the ear of a hearing aid user. In the case of an in-the-ear (ITE) hearing aid instrument, the acoustic output signals from the output directly reach the ear, into which the ITE instrument has been inserted. In the case of a behind-the-ear (BTE) instrument, the housing is usually connected to a tone hook, through the use of which it can be hung onto the concha. The tone hook has an acoustic canal that transmits the output signals of the receiver to the ear of the hearing aid wearer. For that purpose, the receiver is connected to the acoustic canal.

Troublesome feedback can occur during the operation of a hearing aid if acoustic output signals reach the microphone from the receiver. That is because the acoustic signals recorded in the microphone are subsequently amplified and once again reproduced by the receiver. In order to reduce the tendency for feedback, it is known to connect the receiver in as soundproof a manner as possible to the output of the housing or the acoustic canal of the tone hook. The soundproof connection prevents acoustic output signals inside the housing from being able to reach the microphone directly. By way of example, the receiver can be adhesively bonded to a receiver tube leading to the output or tone hook. However, adhesive connections are disadvantageous in that they can only be released and reestablished to a limited extent, which for example becomes necessary when replacing the receiver. Additionally, adhesive connections often do not have a sufficient impact and shock strength and are damaged if the hearing aid is inadvertently dropped. Not least, producing an adhesive connection is a relatively complex and time-intensive production process-step, because a suitable amount of the adhesive has to be metered, distributed carefully and cured for a sufficiently long time after assembling the connection partners.

U.S. Patent Application Publication No. U.S. 2008/0002848 A1 has disclosed a hearing aid constructed as a BTE instrument. Provision is made for a receiver tube for connecting the receiver to the acoustic canal in the tone hook. In order to ensure a soundproof connection between the receiver tube and the receiver, a plug-in connection is provided, which plug-in connection is provided with encircling grooves or ridges. The encircling grooves or ridges can either be provided on only one side of the plug-in connection, that is to say either on the plug or in the socket in such a way that it results in a force-locking connection, or be provided on both sides in such a way that it accomplishes an at least partly form-locking connection.

A form-locking connection is one which connects two elements together due to the shape of the elements themselves, as opposed to a force-locking connection, which locks the elements together by force external to the elements.

International Publication No. WO 2009/016671 A1 has already disclosed a hearing aid in which a tube is provided between the housing and the microphone. The tube is connected in each case by using a reversible snap-on connection.

U.S. Pat. No. 6,522,764 B1 has disclosed a hearing aid constructed as a BTE instrument. The instrument has a modular construction to the extent that all individual components are assembled using snap-on connections.

U.S. Pat. No. 4,418,787 has already disclosed a hearing aid constructed as a BTE instrument. The housing and the tone hook are interconnected by a tube connection with a thread-shaped external wall, which should ensure a connection that is as reliable as possible.

SUMMARY OF THE INVENTION

It is accordingly an object of the invention to provide a receiver tube, a receiver and a hearing aid instrument with a receiver tube, which overcome the hereinafore-mentioned disadvantages of the heretofore-known devices of this general type, which create a connection of a receiver to a receiver tube, in which the connection ensures good acoustic stability and low tendencies for feedback, which can be produced in an uncomplicated fashion in the process and which have a high impact and shock strength. In this case, the term "receiver tube" should be understood to mean a connection piece between an acoustic output of the receiver and an acoustic output opening in a housing of a hearing aid. In this case, this can be a tube leading directly to a housing opening, or a tube leading to an acoustic canal of a tone hook, or a tube forming the acoustic canal. The tube can be round or have arbitrary cross sections and additionally, it can be elongate or exceptionally short.

With the foregoing and other objects in view there is provided, in accordance with the invention, a receiver tube for connecting a receiver in a hearing aid instrument. The receiver tube comprises a receiver connector for connecting the receiver. The receiver connector is constructed as a cup at least partly holding the receiver upon the receiver being connected to the receiver connector. The receiver connector includes a locking mechanism for locking the receiver in a form-locking manner upon connecting the receiver to the receiver connector and the receiver connector includes a flexible element for locking the receiver.

With the objects of the invention in view, there is also provided a receiver for a hearing aid instrument. The receiver is configured to be connected to a receiver tube according to the invention.

With the objects of the invention in view, there is furthermore provided a hearing aid instrument, comprising a receiver tube according to the invention and a receiver to be connected to the receiver tube.

The form-locking connection between the receiver and the receiver connector simplifies the installation of the receiver during the production process or during the replacement thereof because there has to be neither the application of a force, as has to be applied for example when pretensioning or expanding a force-locking connection, nor the establishment of an adhesive connection. The use of a flexible element used for locking can be implemented in such a way that the locking mechanism can be opened and closed as a result of its flexibility. The locking mechanism is brought about by virtue of the fact that the receiver is locked in the connection produced by the form-locking fit. In this case, it is also feasible to strengthen the form-locking connection by an elastic force of the flexible element. This can make the connection between the receiver and the receiver connector more reliable by avoiding an impact or shock load by the flexible locking mechanism in the case of an inadvertent fall, due to the flexible resilience of the locking mechanism. The cup-shaped construction of the receiver connector first of all contributes to the increase in the rigidity and reliability of the form-locking connection to the receiver. Secondly, provided the receiver is held therein, the cup constitutes an acoustic shield which can shield acoustic output signals of the receiver in undesired directions. This contributes to suppressing the tendency for feedback as a result of acoustic signals within a hearing aid housing undesirably reaching the microphone.

In accordance with another advantageous feature of the invention, the locking mechanism is constructed as a frame, which encompasses the connected receiver. The flexible element used for locking can be integrated into or be one piece with the frame. By way of example, the entire frame can have a flexible construction. This results in a stable, simple construction of the locking mechanism and the flexible element used for locking, which can be managed in a particularly simple fashion during the installation of the receiver.

In accordance with a further advantageous feature of the invention, the receiver connector and the receiver tube are of an integral or one-piece construction. The integral construction helps to avoid connection and junction points, and this increases the soundproofing and thus reduces the tendency for feedback. Additionally, the integral or one-piece construction reduces the number of production steps during the assembly of the receiver tube and receiver connector. Furthermore, the reduction in the number of individual parts reduces the logistic production complexity. In this case, the receiver tube and the receiver connector of an integral or one-piece construction can lead directly to the acoustic output of a hearing-aid housing from the receiver, and it can have an exceptionally short structure in this embodiment. In the case of such a short length, the receiver tube resembles a receptacle for assembling the receiver.

In accordance with an advantageous concomitant feature of the invention, the flexible element used for locking is formed as a separate collar, which is at least partly pushed over the connected receiver or the receiver connector.

Other features which are considered as characteristic for the invention are set forth in the appended claims.

Although the invention is illustrated and described herein as embodied in a receiver tube, a receiver and a hearing aid instrument with a receiver tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
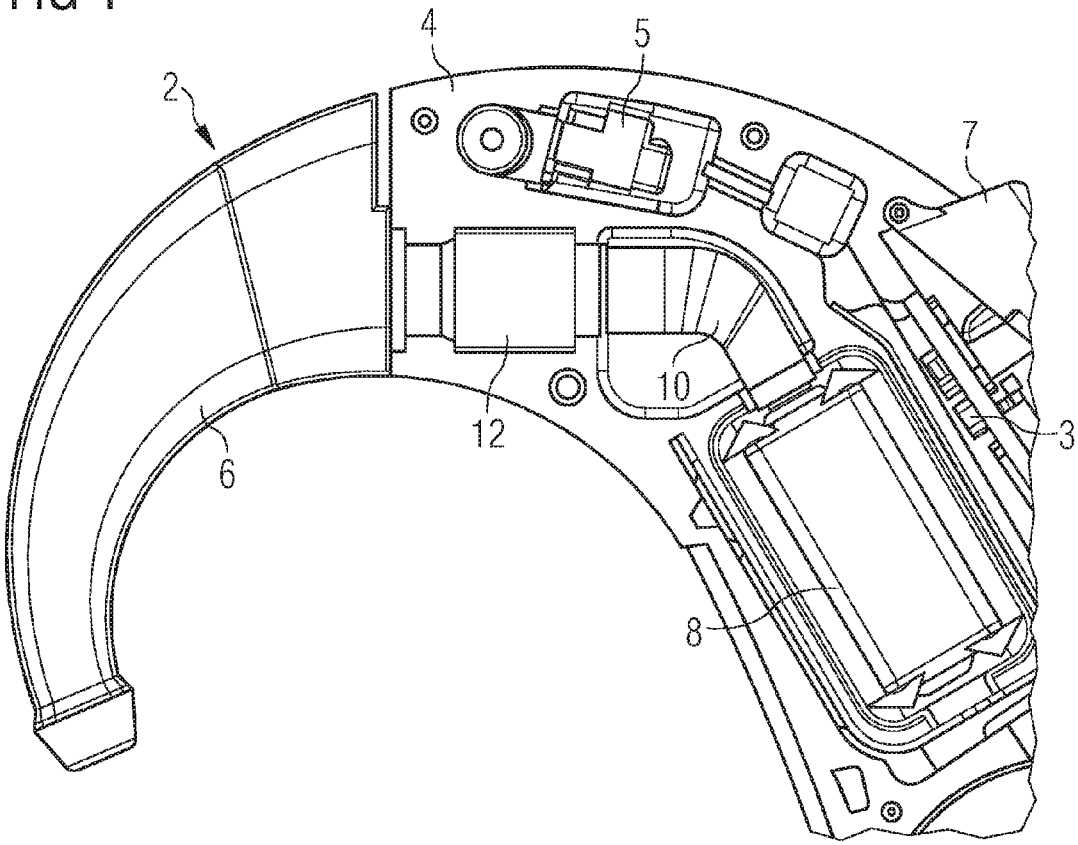
PRIOR ART FIG 1
FIG. 1 is a fragmentary, diagrammatic, longitudinal-sectional view of a BTE hearing aid according to the prior art.

Referring now to the figures of the drawings in detail and first, particularly, to FIG. 1 thereof, there is seen a diagrammatically illustrated section of a BTE hearing aid with an opened housing. The BTE hearing aid 2 includes a tone hook 6, with which it can be mounted behind the concha of a hearing aid wearer. The hearing aid 2 includes a housing 4 that is connected to the tone hook 6. The connection can have a permanent or detachable construction. The tone hook 6 has a sound canal indicated by lines. Acoustic signals are transmitted through the sound canal from the interior of the housing 4 to the end of the tone hook 6. If the hearing aid 2 is used as intended, a non-illustrated tube is connected to a bulging end of the tone hook facing away from the housing 4. That tube transmits the acoustic signals on to the auditory canal of the hearing aid wearer.

A microphone configuration 5 that is used to record acoustic signals from the surroundings is disposed in the housing 4. The microphone configuration 5 can operate unidirectionally, i.e. basically independent of direction, or it can operate substantially dependent on the direction, e.g. bidirectionally or like a directional microphone. Microphone configurations operating in a bidirectional or directed fashion, in particular, are often provided with a plurality of microphones rather than a single microphone.

The microphone configuration 5 is connected to an amplifier configuration 3 through a signal-processing configuration, which is merely diagrammatically indicated in the figure. The signal-processing configuration processes the recorded acoustic signals according to a hearing program. The hearing program can be used for improving a signal-to-noise ratio, for analyzing directed acoustic information, for suppressing or reducing an interference signal or for changing recorded acoustic signals in order to match a specific individual hearing loss. The signal-processing configuration can make further processing processes possible and can react to inputs or parameter adjustments by the hearing aid wearer. At least one switch 7 is provided for manual inputs. The switch can, for example, be constructed as a pushbutton switch, rocker switch or tumbler switch. By way of example, the switch 7 can be used to select a parameter or to switch the hearing aid on and off.

A receiver 8 is connected to the signal-processing configuration. The receiver is actuated by output signals of the signal-processing configuration or the amplifier configuration 3 connected thereto. The receiver 8 generates acoustic signals amplified by the amplifier configuration 3, for example signals from the surroundings recorded by the microphone configuration 5. The amplified signals are passed on to a receiver tube 10, which is permanently or detachably connected to the receiver 8. By way of example, the connection can be secured by an adhesive or can be constructed as a force-locking plug-in connection. The receiver tube 10 transmits the acoustic output signals of the receiver 8 to a connector piece 12, which in turn is connected to a sound canal of the tone hook 6.

The illustrated connection between the receiver 8 and the receiver tube 10 corresponds to the prior art.

Figure 2:
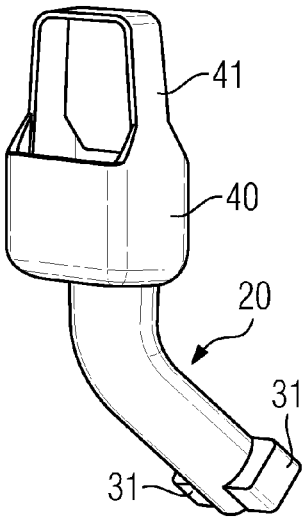
FIGS. 2 and 3 are perspective views of receiver connectors.

FIG. 2 illustrates a receiver tube 20 that forms an exemplary embodiment of the invention. The receiver tube 20 includes a T-piece 31, which is basically formed by two moldings disposed in a T-shaped fashion at the end of the tube. The T-piece 31 is used for the reliable and secure connection of the receiver tube 20 to a connection counter piece. By way of example, as described above, the receiver tube 20 can be connected to a connector piece or directly to the tone hook of a hearing aid. If the receiver tube 20 is used in other hearing aid structures, it can also be connected directly to the hearing-aid housing through the T-piece 31, or to the housing of a receiver to be disposed in the auditory canal (a so-called receiver-in-canal "RIC" construction).

A cup 40 is integrally formed on, or is formed as one piece with, the end of the receiver tube 20 opposite to the T-piece 31. The cup 40 is used to hold a receiver, which is not illustrated. The receiver can be inserted into the cup 40, which is why the shape, i.e. the cross section and the length, of the cup 40 mainly conforms to the shape of the receiver to be inserted. The cup has an opening toward the sound canal and therefore the interior of the cup 40 opens directly into the sound canal.

The receiver can be inserted into the cup 40 in such a way that the signal output of the receiver is directly connected to the sound canal. This allows acoustic output signals of the receiver to be emitted into the sound canal and to be transmitted through the latter.

In order to ensure a connection between the receiver and the sound canal which is as soundproof as possible, the cup 40 encompasses a receiver as tightly as possible as soon as the latter has been inserted into the cup 40. For this purpose, the interior wall of the cup 40 or the exterior wall of the receiver to be inserted can be formed of a flexible, soundproof material. A tight seat of the receiver in the cup 40 with as little play as possible is achieved by cross sections with the best possible correspondence and low tolerances.

A receiver inserted into the cup 40 is fixed by a frame 41. The frame 41 ensures that an inserted receiver cannot slip out of the cup 40. Therefore, it encompasses an inserted receiver as tightly as possible and without play. In order to obtain a detachable connection, which is advantageous for replacing the receiver for example, the frame 41 is flexible to the extent that it can be elastically bent to the side or stretched in the direction away from the cup in order to insert or remove a receiver. For this purpose, the entire frame 41 or parts thereof, e.g. side rods or struts, are produced from a suitable, elastic material. The frame 41 thus pushes a receiver inserted into the cup 40 in the direction of a base of the cup and therefore the acoustic output of the receiver is connected to the sound canal in the receiver tube 20 as securely and tightly as possible, but it is reversibly connected at the same time. This connection requires no additional securing by adhesive measures and is, on one hand, a force-locking connection because the frame 41 pushes the receiver into the cup 40, but it is also, on the other hand, a form-locking connection as a result of matching the respective shape of the frame 41 and cup 40 to the receiver to be inserted in such a way that the latter is encompassed with as little play and as precisely as possible. Depending on the embodiment or refinement, the force-locking can also be dispensed with herein and a connection can be established by form-locking measures only.

Figure 3:
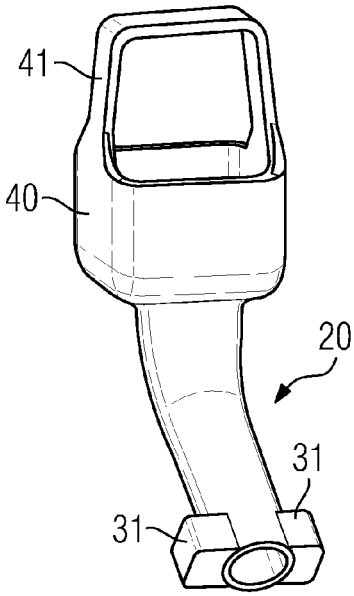

FIG. 3 illustrates the above-described receiver tube 20 in a different perspective. The receiver tube 20 has the above-described components and they are provided with the same reference symbols. Contrary to the preceding illustration, the open end of the sound canal disposed within the receiver tube 20 can be seen at the end thereof provided with the T-piece 31.

Figure 4:
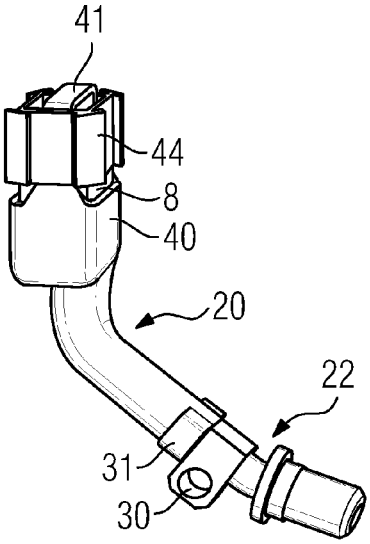
FIGS. 4 and 5 are perspective views of a receiver connector with a receiver and collar.

FIG. 4 in turn illustrates the above-described receiver tube 20, using the same reference symbols for the same components, in a changed perspective. In contrast to the preceding illustration, the receiver tube 20 is connected by a connector piece 22 to the end provided with the T-piece 31. The connector piece 22 includes an attachment ear, eyelet or ring 30, through the use of which it can be attached, for example, to the housing of a hearing aid or to a supporting frame. A connection counter piece for attaching the receiver tube 20 through the use of the T-piece 31 has not been illustrated.

A receiver 8 is inserted into the cup 40 of the receiver tube 20. The receiver has been illustrated in such a way that it is only partly visible. The receiver 8, as described above, is encompassed in a form-locking and tight fashion by the cup 40 and the frame 41. A collar 44 has been pushed on for additionally securing the connection. The collar 44 fixes the receiver 8 in the cup 40 in addition to the frame 41. The collar 44 can have an elastic construction in such a way that it exerts a tensioning force that additionally fixes the receiver.

As explained above, the soundproofing of the connection is increased by the connection between the cup 40 and the receiver 8 being as tight as possible and without play. It is clear that as the length of the cup 40 increases, the sealing surface increases and hence the soundproofing of the connection increases. The collar 44 can be constructed in such a way that, unlike that shown in the illustration, it is pushed on right up to the edge of the cup in order to additionally increase the soundproofing.

Figure 5:
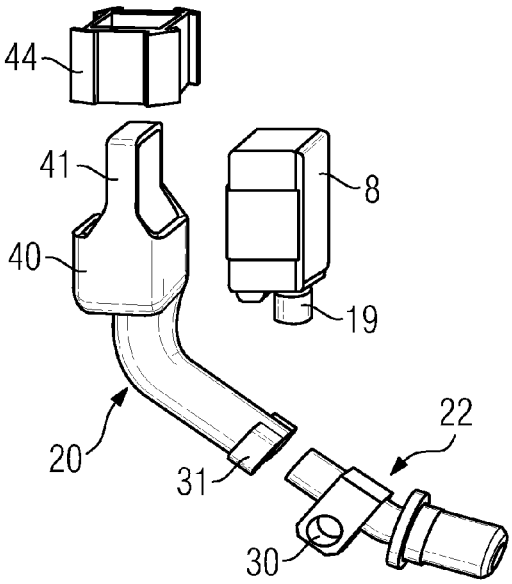

FIG. 5 illustrates the preceding components using the same reference symbols and being exploded for the purposes of the explanation. The receiver 8 has a collar 19 at its acoustic output, through the use of which it can be inserted into the sound canal in the receiver tube 20. This results in an additional increase in the stability of the mutual connection and an improvement in the seat and the soundproofing.

Figure 6:
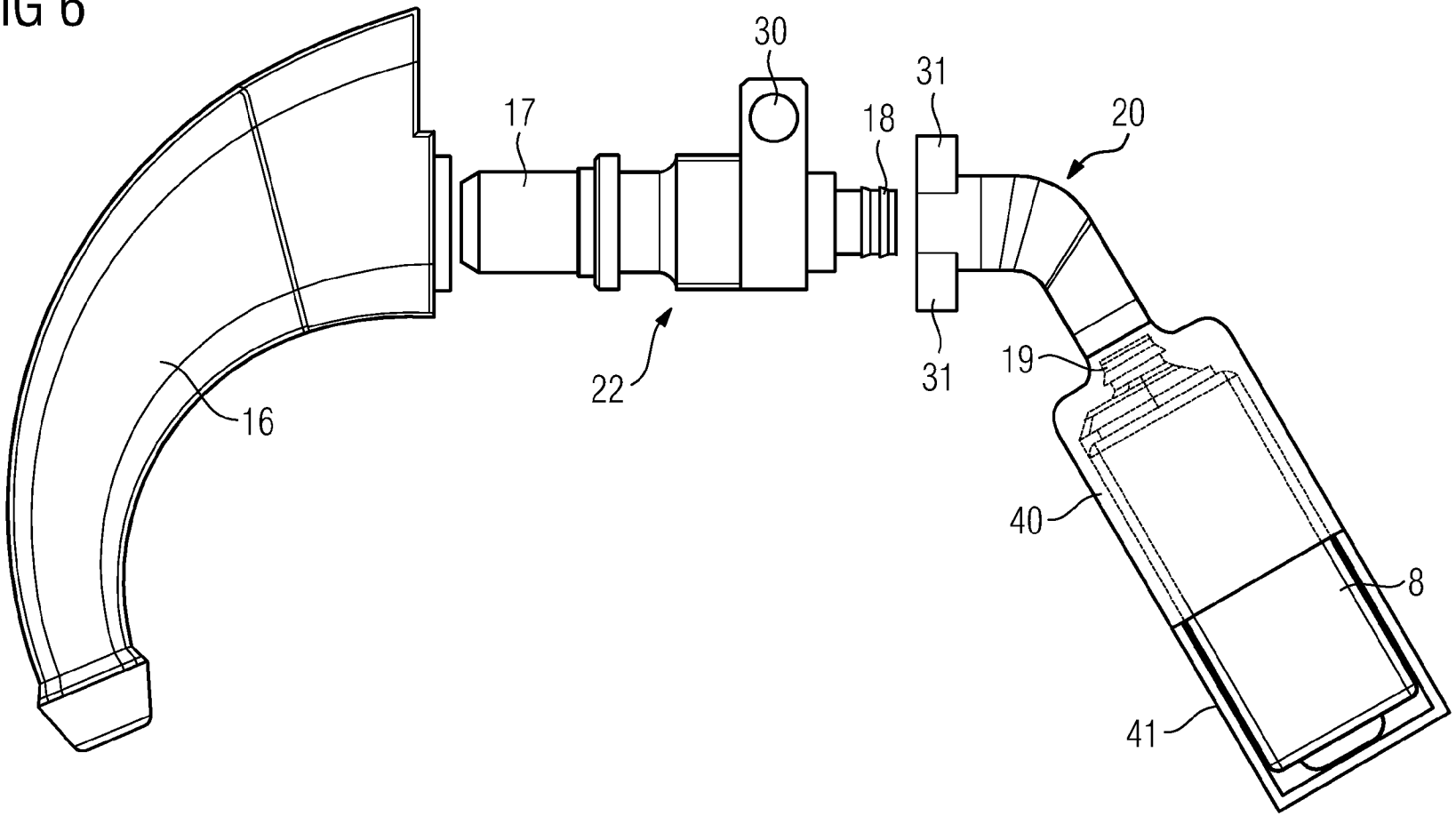
FIG. 6 is an elevational view of a BTE tone hook with a receiver connector and receiver.

FIG. 6 illustrates a tone hook 16 of a BTE hearing aid, on its own. The hearing aid has not been illustrated, but rather only the above-described components for connecting the receiver 8 to the tone hook 16 or the sound canal disposed therein. The connector piece 22 is first of all connected directly to the tone hook 16. For this purpose, the connector piece 22 has a connector stub 17, which can be placed onto the tone hook 16 or can, at least in part, be inserted into the latter. The connector stub 17 directly connects a non-illustrated sound canal disposed within the connector piece 22 to the sound canal of the tone hook 16. The connector piece 22 additionally has the above-described attachment eyelet 30, through the use of which it can be attached, for example, to a supporting frame of a hearing aid. A further connector stub 18 is used for the connection to the receiver tube 20 and it has a periphery provided with flexible encircling contours. The encircling contours are used to increase the soundproofing and the flexibility of the connection to the receiver tube 20.

The receiver tube 20 is connected to the connector piece 22 as described above while using the same reference symbols. A receiver 8 has been inserted into the cup of the receiver tube 40 and the collar 19 thereof is likewise provided with encircling flexible contours. As explained above, the receiver has been inserted into the receiver tube 20 in a detachable fashion, for which purpose the frame 41 has a flexible construction. The collar described above has not been illustrated, but it can likewise additionally be provided.

A basic concept of the invention can be summarized as follows: The invention relates to a receiver tube for connecting a receiver of a hearing aid instrument, and to a hearing aid instrument with such a receiver tube. The connection should ensure good acoustic stability and low tendencies for feedback, be able to be produced in an uncomplicated fashion in the process, and have a high impact and shock strength. This object is achieved according to the invention by a receiver tube (20) for connecting a receiver (8) including a receiver connector constructed for connecting the receiver (8), wherein the receiver connector is constructed as a cup (40), which at least partly holds a receiver (8) when the latter is connected to the receiver connector, the receiver connector includes a locking mechanism, through the use of which a receiver (8) is locked in a form-locking fashion when it is connected to the receiver connector, and the receiver connector includes a flexible element used for locking the receiver. The form-locking connection between the receiver and the receiver connector simplifies the installation of the receiver during the production process or during the replacement thereof, because there has to be neither the application of a force, as has to be applied for example when pretensioning or expanding a force-locking connection, nor the establishment of an adhesive connection. The locking mechanism can be opened and closed by the flexible element. The cup-shaped construction of the receiver connector first of all contributes to the increase in the rigidity and reliability of the form-locking connection to the receiver. Secondly, the cup constitutes an acoustic shield.

The invention claimed is:

1. A receiver tube for connecting a receiver in a hearing aid instrument, the receiver tube comprising:

a receiver connector for connecting the receiver;

said receiver connector being constructed as a cup at least partly holding the receiver upon the receiver being connected to said receiver connector;

said receiver connector including a locking mechanism for locking the receiver in a form-locking manner upon connecting the receiver to the receiver connector; and said locking mechanism including a flexible element for locking the receiver, said locking mechanism being constructed as a frame encompassing the connected receiver.

2. The receiver tube according to claim 1, wherein said receiver connector is an integral part of the receiver tube.

3. The receiver tube according to claim 1, wherein said receiver connector and the connected receiver at least partly form a sound-damping or soundproof connection.

4. The receiver tube according to claim 1, wherein said receiver connector is formed as one piece with a remainder of the receiver tube.

5. A receiver for a hearing aid instrument, the receiver comprising:

a connection configuration for connecting the receiver to a receiver tube according to claim 1.

6. A hearing aid instrument, comprising:

a receiver tube according to claim 1; and a receiver to be connected to said receiver tube.

7. A receiver tube for connecting a receiver in a hearing aid instrument, the receiver tube comprising:

a receiver connector for connecting the receiver;

said receiver connector being constructed as a cup at least partly holding the receiver upon the receiver being connected to said receiver connector;

said receiver connector including a locking mechanism for locking the receiver in a form-locking manner upon connecting the receiver to the receiver connector; and said locking mechanism including a flexible element for locking the receiver, said flexible element for locking and said receiver connector being integrally constructed.

8. The receiver tube according to claim 7, wherein said flexible element for locking is integrated into said locking mechanism.

9. The receiver tube according to claim 8, wherein said flexible element for locking is formed by said locking mechanism itself.

10. A receiver tube for connecting a receiver in a hearing aid instrument, the receiver tube comprising:

a receiver connector for connecting the receiver;

said receiver connector being constructed as a cup at least partly holding the receiver upon the receiver being connected to said receiver connector;

said receiver connector including a locking mechanism for locking the receiver in a form-locking manner upon connecting the receiver to the receiver connector; and said locking mechanism including a flexible element for locking the receiver, said flexible element for locking being a separate collar at least partly pushed over at least one of the connected receiver or said receiver connector.

11. A receiver tube for connecting a receiver in a hearing aid instrument, the receiver tube comprising:

a receiver connector for connecting the receiver;

said receiver connector being constructed as a cup at least partly holding the receiver upon the receiver being connected to said receiver connector;

said receiver connector including a locking mechanism for locking the receiver in a form-locking manner upon connecting the receiver to the receiver connector;

said locking mechanism including a flexible element for locking the receiver; and a connector-piece connector being constructed for connecting a connector piece, said connector-piece connector including a locking element with a T-shaped construction.

12. The receiver tube according to claim 11, wherein said locking mechanism is constructed as a hook or bracket.

13. A receiver tube for connecting a receiver in a hearing aid instrument, the receiver tube comprising:

a receiver connector for connecting the receiver;

said receiver connector being constructed as a cup at least partly holding the receiver upon the receiver being connected to said receiver connector;

said receiver connector including a locking mechanism for locking the receiver in a form-locking manner upon connecting the receiver to the receiver connector; and said locking mechanism including a flexible element for locking the receiver, said flexible element for locking and said receiver connector being constructed as one piece.

* * * * *